US011587511B2

(12) United States Patent
Liu et al.

(10) Patent No.: US 11,587,511 B2
(45) Date of Patent: Feb. 21, 2023

(54) DISPLAY PANEL, DISPLAY DEVICE AND DRIVING METHOD

(71) Applicant: BOE Technology Group Co., Ltd., Beijing (CN)

(72) Inventors: Jing Liu, Beijing (CN); Zihua Li, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/488,115

(22) Filed: Sep. 28, 2021

(65) Prior Publication Data

US 2022/0208101 A1 Jun. 30, 2022

(30) Foreign Application Priority Data

Dec. 25, 2020 (CN) ..... 202011564439.9

(51) Int. Cl.
*G09G 3/3266* (2016.01)
*G09G 3/3233* (2016.01)
*G09G 3/3258* (2016.01)

(52) U.S. Cl.
CPC ..... *G09G 3/3266* (2013.01); *G09G 3/3233* (2013.01); *G09G 3/3258* (2013.01); *G09G 2300/0819* (2013.01); *G09G 2300/0852* (2013.01); *G09G 2310/0286* (2013.01); *G09G 2320/0233* (2013.01)

(58) Field of Classification Search
None
See application file for complete search history.

(56) References Cited

U.S. PATENT DOCUMENTS 6,307,681 B1 * 10/2001 Aoki ..... G09G 3/3648 345/94
9,870,727 B2 * 1/2018 Lee ..... G09G 3/2003
2001/0015711 A1 * 8/2001 Aoki ..... G09G 3/3611 345/92
2002/0169575 A1 * 11/2002 Everitt ..... G09G 3/3283 702/107
2005/0116747 A1 * 6/2005 Shimoda ..... G09G 3/3283 327/108
2006/0087488 A1 * 4/2006 Ito ..... G09G 3/2011 345/103
2006/0221015 A1 * 10/2006 Shirasaki ..... G09G 3/325 345/77

(Continued)

*Primary Examiner* — Nitin Patel
*Assistant Examiner* — Amen W Bogale
(74) *Attorney, Agent, or Firm* — IPro, PLLC

(57) ABSTRACT

The present disclosure provides a display panel, a display device and a driving method. The display panel includes a display substrate and a driving chip. The display panel is configured to write a data signal to a corresponding pixel circuit at a pre-writing phase and a target data writing phase. The driving chip includes a voltage compensation module configured to obtain a compensation voltage value for the pixel circuits in each row in accordance with the quantity of pre-writing phases. Each pixel circuit is configured to write a pre-writing voltage stored in a parasitic capacitor to a gate electrode of a driving transistor in response to a pre-scanning signal at the pre-writing phase, and write a target writing voltage stored in the parasitic capacitor to the gate electrode of the driving transistor in response to a target scanning signal at the target data writing phase.

11 Claims, 6 Drawing Sheets

(56) References Cited

U.S. PATENT DOCUMENTS

2006/0262051 A1* 11/2006 Kim ..... G09G 3/325 345/76
2007/0046609 A1* 3/2007 Lee ..... G09G 3/3648 345/94
2007/0080905 A1* 4/2007 Takahara ..... G09G 3/3258 345/76
2008/0042949 A1* 2/2008 Chen ..... G09G 3/3659 345/87
2008/0111773 A1* 5/2008 Tsuge ..... G09G 3/3241 345/76
2009/0244055 A1* 10/2009 Asano ..... G09G 3/3233 345/84
2009/0309865 A1* 12/2009 Kohno ..... G09G 3/3233 345/82
2010/0315403 A1* 12/2010 Kaneyoshi ..... G09G 3/3614 345/211
2012/0056917 A1* 3/2012 Ito ..... G09G 3/3614 345/691
2013/0100173 A1* 4/2013 Chaji ..... G09G 3/3275 345/76
2013/0293450 A1* 11/2013 Wu ..... G09G 3/3233 345/82
2014/0035965 A1* 2/2014 Toyomura ..... G09G 3/2018 345/76
2014/0118328 A1* 5/2014 Guo ..... G09G 3/3233 345/212
2014/0118331 A1* 5/2014 Jeon ..... G09G 3/3614 345/99
2014/0267213 A1* 9/2014 Wakabayashi ..... G09G 3/3648 345/212
2014/0320521 A1* 10/2014 Oh ..... G09G 3/3648 345/601
2016/0125820 A1* 5/2016 Ito ..... G09G 3/3685 345/99
2016/0307529 A1* 10/2016 Tseng ..... G09G 3/3258
2017/0186379 A1* 6/2017 Zhou ..... G09G 3/3258
2017/0200412 A1* 7/2017 Gu ..... G09G 3/3266
2018/0033368 A1* 2/2018 Chaji ..... H05B 47/165
2018/0122313 A1* 5/2018 Mizusako ..... G09G 3/3611
2019/0035345 A1* 1/2019 Jinta ..... G09G 3/20
2019/0228725 A1* 7/2019 Bansho ..... G02F 1/13306
2019/0333456 A1* 10/2019 Lim ..... G09G 3/36
2021/0118369 A1* 4/2021 Takasugi ..... G09G 3/3266

* cited by examiner

DISPLAY PANEL, DISPLAY DEVICE AND DRIVING METHOD

CROSS-REFERENCE TO RELATED APPLICATION

This application claims a priority of the Chinese patent application No. 202011564439.9 filed on Dec. 25, 2020, which is incorporated herein by reference in its entirety.

TECHNICAL FIELD

The present disclosure relates to the field of display technology, in particular to a display panel, a display device and a driving method.

BACKGROUND

As compared with a conventional Liquid Crystal Display (LCD) substrate, an Organic Light-Emitting Diode (OLED) display substrate has been widely used in smart phones, wearable devices, notebook computers, televisions, Virtual Reality (VR) devices and many other devices due to such advantages as self-luminescence, wide color gamut, high contrast, and being light and thin.

In the related art, usually a multi-pulse driving mode is adopted by the OLED display substrate to improve a response time of a display panel. However, due to the existing multi-pulse driving mode, display unevenness occurs for the display panel, especially insufficient display brightness occurs for the last few rows of the display panel.

SUMMARY

An object of the present disclosure is to provide a display panel, a display device and a driving method, so as to solve the above-mentioned problem.

In one aspect, the present disclosure provides in some embodiments a display panel, including a display substrate and a driving chip. The driving chip is configured to transmit a control signal and a data signal to the display substrate. The display substrate includes a plurality of data lines and a plurality of pixel circuits arranged in rows. Each pixel circuit includes a storage capacitor and a driving transistor, the storage capacitor is coupled between a gate electrode of the driving transistor and a first power source end, and each pixel circuit is electrically coupled to the data line. The display substrate further includes a conductive member insulated and spaced apart from the data line, and the data line and the conductive member form a parasitic capacitor. The display panel is configured to write the data signal to a corresponding pixel circuit at at least one pre-writing phase and a target data writing phase. The driving chip further includes a voltage compensation module configured to obtain a compensation voltage value for the pixel circuits in each row in accordance with the quantity of pre-writing phases. Each pixel circuit is configured to write a pre-writing voltage stored in the parasitic capacitor to the gate electrode of the driving transistor in response to a pre-scanning signal at the pre-writing phase, and write a target writing voltage stored in the parasitic capacitor to the gate electrode of the driving transistor in response to a target scanning signal at the target data writing phase. Both the pre-writing voltage and the target writing voltage include the compensation voltage value.

In a possible embodiment of the present disclosure, the voltage compensation module is further configured to determine, in accordance with the quantity of pre-writing phases, the quantity of rows of pixel circuits where voltage compensation needs to be performed as $A=(2Q-1)+1$, and a range of the rows of pixel circuits where voltage compensation needs to be performed as $N-(2Q-1)$ to N, where A represents the quantity of rows of pixel circuits where voltage compensation needs to be performed in the display panel, Q represents the quantity of pre-writing phases, Q is a natural number greater than or equal to 1, N represents the quantity of rows of pixels in the display panel, and N is a natural number greater than or equal to 2. The voltage compensation module is further configured to obtain the compensation voltage value for the pixel circuits in each row in accordance with a position of a row where the pixel circuit is located and the quantity of pre-writing phases through $\Delta V(n-a)=V(n-2Q)-V(n-a)$, where n is an integer less than or equal to N, a is an integer greater than or equal to 0 and less than A, $V(N-2Q)$ represents a writing voltage to be applied to the pixel circuit in a row where pixel compensation does not need to be performed, and $V(N-a)$ represents a writing voltage to be applied to the pixel circuit in a row where pixel compensation needs to be performed.

In a possible embodiment of the present disclosure, the plurality of data lines in the display substrate is divided into a plurality of data line groups, each data line group includes at least two data lines and a data selector corresponding to each data line, and each data line group is configured to, in response to a gating state of each data selector, apply a data signal from the driving chip to a corresponding data line.

In a possible embodiment of the present disclosure, each pixel circuit includes an input transistor, a threshold compensation transistor, a driving transistor, an enabling transistor, a storage capacitor and a light-emitting element. Each of the input transistor, the threshold compensation transistor, the driving transistor and the enabling transistor includes a gate electrode, a first electrode and a second electrode, the storage capacitor includes a first electrode and a second electrode, and the light-emitting element includes a first electrode and a second electrode. The first electrode of the storage capacitor is configured to receive a first power source signal, and the second electrode of the storage capacitor is electrically coupled to the gate electrode of the driving transistor. The gate electrode of the input transistor is configured to receive the pre-scanning signal and the target scanning signal, the first electrode of the input transistor is electrically coupled to the data line, and the second electrode of the input transistor is electrically coupled to the first electrode of the driving transistor. The input transistor is configured to enable the data line to be electrically coupled to the first electrode of the driving transistor in response to any one of the pre-scanning signal and the target scanning signal. The gate electrode of the threshold compensation transistor is configured to receive the pre-scanning signal and the target scanning signal, the first electrode of the threshold compensation transistor is electrically coupled to the second electrode of the driving transistor, and the second electrode of the threshold compensation transistor is electrically coupled to the gate electrode of the driving transistor. The threshold compensation transistor is configured to enable the second electrode of the driving transistor to be electrically coupled to the gate electrode of the driving transistor in response to any one of the pre-scanning signal and the target scanning signal. The gate electrode of the enabling transistor is configured to receive an enabling signal, the first electrode of the enabling transistor is electrically coupled to the second electrode of the driving transistor, and the second electrode of the enabling transistor is electrically coupled to the first electrode of the light-emitting element. The enabling transistor is configured to enable the second electrode of the driving transistor to be electrically coupled to the first electrode of the light-emitting element in response to the enabling signal. The second electrode of the light-emitting element is configured to receive a second power source signal.

In a possible embodiment of the present disclosure, the display substrate further includes a gate driving circuit configured to output the pre-scanning signal to a corresponding pixel circuit in accordance with the quantity of pre-writing phases while outputting the target scanning signal to the pixel circuits in an $n^{th}$ row, where n is an integer less than or equal to N.

In a possible embodiment of the present disclosure, the gate driving circuit is a single-sided gate driving circuit or a double-sided gate driving circuit.

In another aspect, the present disclosure provides in some embodiments a display device including the above-mentioned display panel.

In yet another aspect, the present disclosure provides in some embodiments a method for driving the above-mentioned display panel, including: obtaining, by a voltage compensation module of a driving chip, a compensation voltage value for pixel circuits in each row in accordance with the quantity of pre-writing phases; writing, by the pixel circuit, a pre-writing voltage stored in a parasitic capacitor to a gate electrode of a driving transistor in response to a pre-scanning signal at a pre-writing phase, the pre-writing voltage including the compensation voltage value; and writing, by the pixel circuit, a target writing voltage stored in the parasitic capacitor to the gate electrode of the driving transistor in response to a target scanning signal at the target data writing phase, the target writing voltage including the compensation voltage value.

In a possible embodiment of the present disclosure, the obtaining, by the voltage compensation module of the driving chip, the compensation voltage value for the pixel circuits in each row in accordance with the quantity of pre-writing phases includes: determining, by the voltage compensation module in accordance with the quantity of pre-writing phases, the quantity of rows of pixel circuits where voltage compensation needs to be performed as $A=(2Q-1)+1$, and a range of the rows of pixel circuits where voltage compensation needs to be performed as $N-(2Q-1)$ to N, where A represents the quantity of rows of pixel circuits where voltage compensation needs to be performed in the display panel, Q represents the quantity of pre-writing phases, Q is a natural number greater than or equal to 1, N represents the quantity of rows of pixels in the display panel, and N is a natural number greater than or equal to 2; and obtaining, by the voltage compensation module, the compensation voltage value for the pixel circuits in each row in accordance with a position of a row where the pixel circuit is located and the quantity of pre-writing phases through $\Delta V(n-a)=V(n-2Q)-V(n-a)$, where n is an integer less than or equal to N, a is an integer greater than or equal to 0 and less than A, $V(N-2Q)$ represents a writing voltage to be applied to the pixel circuit in a row where pixel compensation does not need to be performed, and $V(N-a)$ represents a writing voltage to be applied to the pixel circuit in a row where pixel compensation needs to be performed.

In a possible embodiment of the present disclosure, the plurality of data lines in the display substrate is divided into a plurality of data line groups, and each data line group includes at least two data lines and a data selector corresponding to each data line. The method further includes, in response to a gating state of each data selector, applying, by each data line group, a data signal from the driving chip to a corresponding data line.

In a possible embodiment of the present disclosure, the display substrate further includes a gate driving circuit, and the method further includes outputting, by the gate driving circuit, the pre-scanning signal to a corresponding pixel circuit in accordance with the quantity of pre-writing phases while outputting the target scanning signal to the pixel circuits in an $n^{th}$ row, where n is an integer less than or equal to N.

BRIEF DESCRIPTION OF THE DRAWINGS

In order to illustrate the technical solutions of the present disclosure in a clearer manner, the drawings desired for the present disclosure will be described hereinafter briefly. Obviously, the following drawings merely relate to some embodiments of the present disclosure, and based on these drawings, a person skilled in the art may obtain the other drawings without any creative effort.

DETAILED DESCRIPTION

Figure 1A:
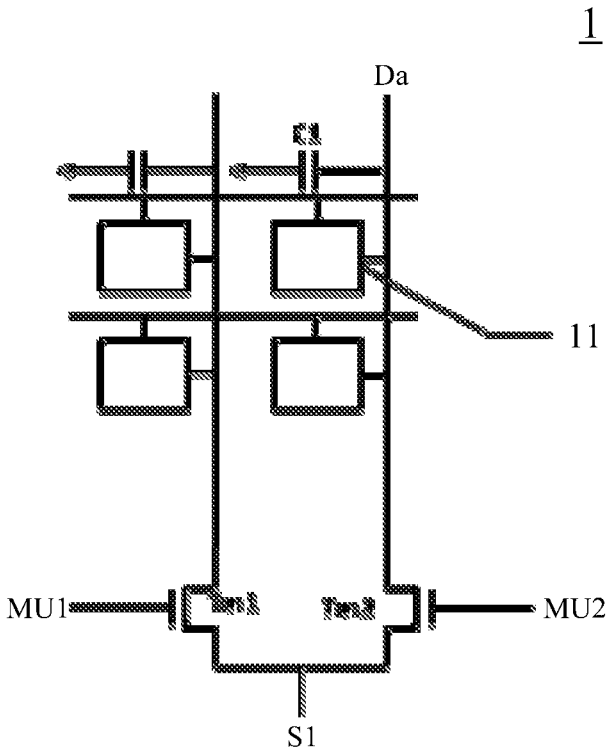
FIG. 1*a* is a schematic view of a conventional display substrate.

The present disclosure will be described hereinafter in conjunction with the drawings and embodiments. Similar members in the drawings are represented by an identical reference numeral. The following embodiments are for illustrative purposes only, but shall not be used to limit the scope of the present disclosure.

It should be further appreciated that, such words as "first" and "second" are merely used to separate one entity or operation from another entity or operation, but are not necessarily used to represent or imply any relation or order between the entities or operations. In addition, such terms as "include" or "including" or any other variations involved in the present disclosure intend to provide non-exclusive coverage, so that a procedure, method, article or device including a series of elements may also include any other elements not listed herein, or may include any inherent elements of the procedure, method, article or device. If without any further limitations, for the elements defined by such sentence as "including one . . . ", it is not excluded that the procedure, method, article or device including the elements may also include any other identical elements.

FIG. 1*a* is a partial schematic view of a conventional display substrate. As shown in FIG. 1*a*, the display substrate 1 includes a plurality of pixel circuits 11 arranged in an array form. Each pixel circuit 11 is coupled to a corresponding data line Da, and the data line Da forms a parasitic capacitor C1 with the other conductive structure on the display substrate. Data selectors are configured to provide a signal from a data signal input end S1 to different data lines Da at different time points. Each data selector includes gating transistors Tm1 and Tm2 as shown in FIG. 1*a*. The gating transistor Tm1 is controlled by a gating end MU1, and the gating transistor Tm2 is controlled by a gating end MU2.

Figure 1B:
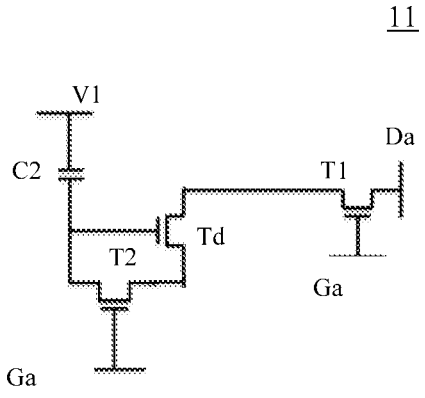
FIG. 1*b* is a schematic view of a pixel circuit in the conventional display substrate.

FIG. 1*b* is a schematic view of the pixel circuit in FIG. 1*a*. As shown in FIG. 1*b*, each pixel circuit 11 includes a storage capacitor C2, a driving transistor Td, a scanning end Ga, an input transistor T1, a light-emitting element (not shown), and a resetting end (not shown).

Figure 1C:
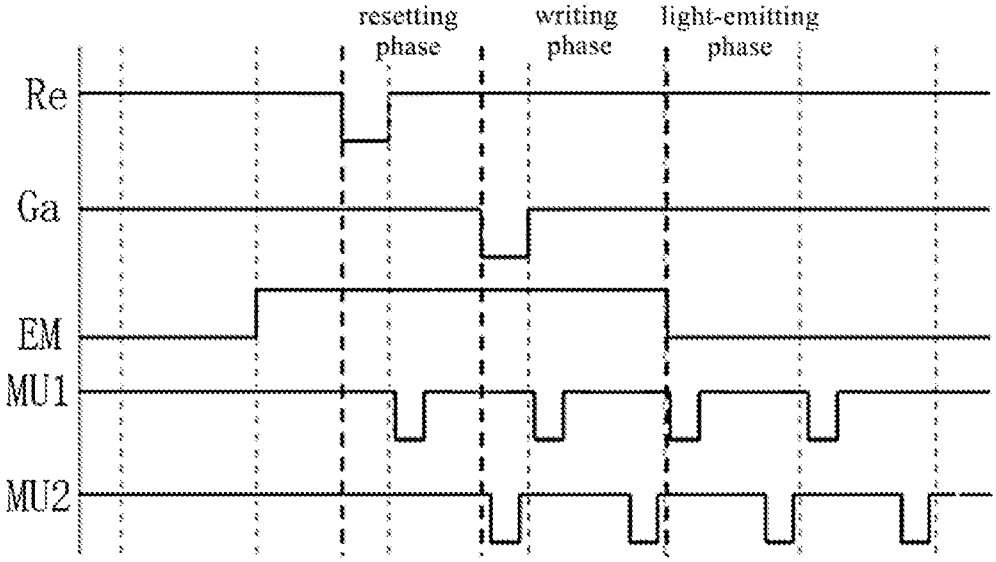
FIG. 1*c* is a driving sequence diagram of the structure in FIG. 1*a;*

When the display substrate is driven, taking the pixel circuits in one row as an example, as shown in FIG. 1*c*, at a resetting phase, a resetting control signal is applied to the resetting end Re of each pixel circuit 11 in the row, and then an effective signal is applied to the gating ends MU1 and MU2 sequentially, so as to turn on the gating transistors Tm1 and Tm2 of the data selector sequentially. When the gating transistor Tm1 is turned on, a signal from a data signal input end S1 is stored in the parasitic capacitor C1 corresponding to the data line coupled to the gating transistor Tm1, and when the gating transistor Tm2 is turned on, a signal from the data signal input end S1 is stored in the parasitic capacitor C1 corresponding to the data line coupled to the gating transistor Tm2. At a data writing phase, a scanning signal is applied to the scanning end Ga of the pixel circuit, so as to write a voltage stored in the parasitic capacitor C1 into a gate electrode of the driving transistor Td. At a light-emission control phase, a light-emission control signal is applied to the light-emission control end EM of the light-emitting element, so as to turn on a light-emission control transistor T3 of the light-emitting element, thereby to drive the light-emitting element to emit light.

Figure 1D:
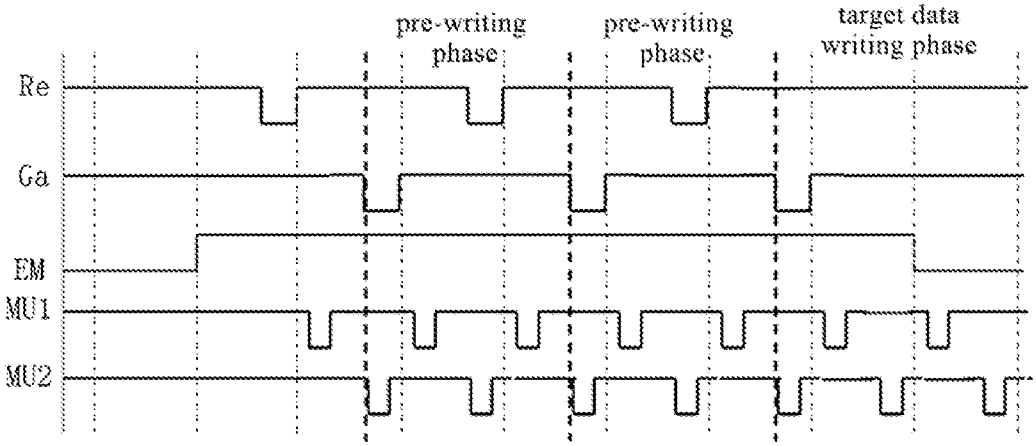
FIG. 1*d* is another driving sequence diagram of the structure in FIG. 1*a;*

In order to further reduce a response time for driving the display substrate, the display substrate is driven in a multi-pulse pre-writing mode in the related art. As shown in FIG. 1*d*, a working period of the pixel circuits 11 in each row includes a plurality of resetting phases, a plurality of pre-writing phases, and a target data writing phase. At each resetting phase, a resetting signal is applied to the pixel circuit 11 to reset the gate electrode of the driving transistor Td. At each pre-writing phase, a pre-scanning signal is applied to the pixel circuit 11 so as to apply a pre-writing voltage to the gate electrode of the driving transistor Td. At the target writing phase, a target scanning signal is applied to the scanning end Ga of the pixel circuit 11, so as to apply a target writing voltage to the gate electrode of the driving transistor Td. However, in this driving sequence, such a problem as insufficient brightness occurs for the last few rows of pixel circuits.

In view of the above-mentioned problem, it is found through researches and experiments that there are the following reasons.

Figure 1E:
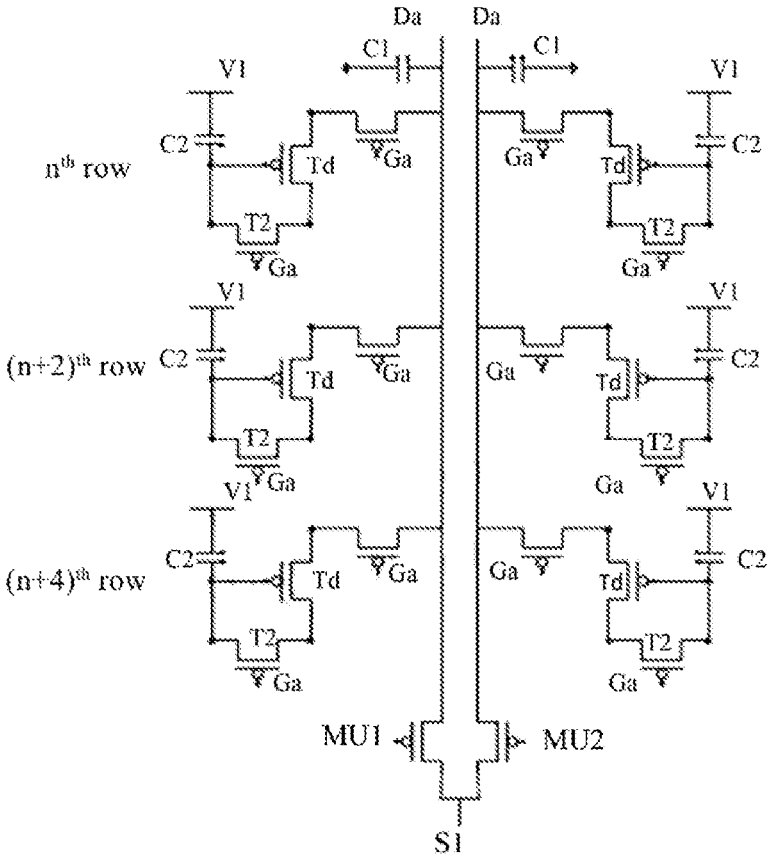
FIG. 1*e* is a circuit diagram of the pixel circuits in multiple rows.
Figure 1F:
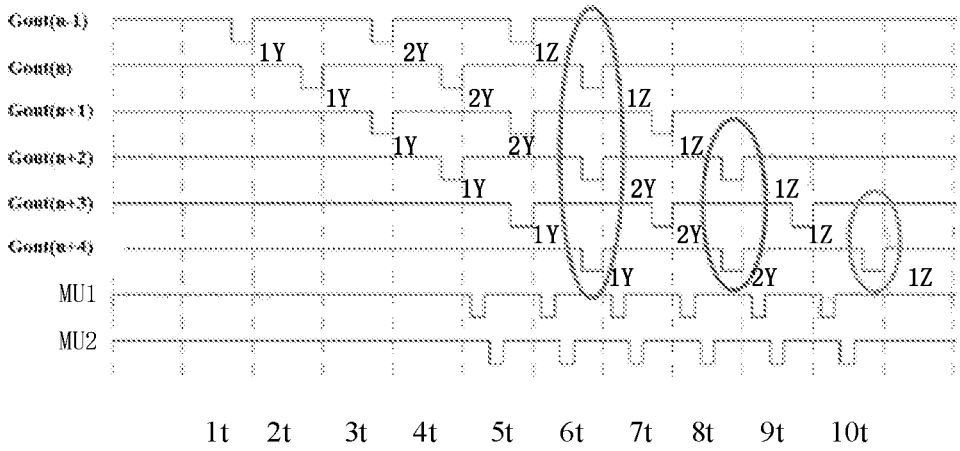
FIG. 1*f* is a driving sequence diagram when the pixel circuits in multiple rows are driven.

As shown in FIG. 1*e*, the display panel includes two data selectors and the pixel circuits in n+4 rows. The two data selectors are controlled by MU1 and MU2 respectively. Pixel circuits in an $(n+4)^{th}$ row are pixel circuits in a last row in the display panel. As shown in FIG. 1*f*, when the display panel is driven in a multi-pulse mode, the pre-scanning signal or target scanning signal are applied to the scanning end Ga at a same frequency, and the pre-scanning signal or the target scanning signal is applied to the scanning ends Ga of two pixel circuits separated from each other by one row at the same time. For example, when a signal is applied to the scanning end Ga of pixel circuit in an $(n+3)^{th}$ row, the signal is applied to the scanning ends Ga of the pixel circuits in an $(n-1)^{th}$ row and an $(n+1)^{th}$ row at the same time.

It should be appreciated that, 10 driving periods, i.e., 1*t* to 10*t*, are shown in FIG. 1*f*.

In addition, when the display panel is driven in the multi-pulse driving mode and the pixel circuits in two adjacent rows are at a same driving phase, a pixel circuit close to the data signal input end S1 is at the driving phase within a next period. For example, as shown in FIG. 1*f*, when a pixel circuit in the $(n-1)^{th}$ row is at a first pre-writing phase 1Y within a first period 1*t*, an adjacent pixel circuit in the $n^{th}$ row close to the data signal input end S1 enters the first pre-writing phase 1Y within a next period 2*t*, and an adjacent pixel circuit in the $(n+1)^{th}$ row close to the data signal input end S1 enters the first pre-writing phase 1Y within a next period 3*t*. At this time, within the period 3*t*, the pre-scanning signal is applied to the pixel circuits in the $(n-1)^{th}$ row simultaneously, so that the pixel circuits in the $(n-1)^{th}$ row enter second pre-writing phase 2Y. Further, with a period 5*t*, the scanning signal is applied to the scanning end Ga, and the pixel circuits in the $(n-1)^{th}$ row enter a first target data writing phase 1Z. At this time, the pixel circuits in the $(n+1)^{th}$ row are at the second pre-scanning phase 2Y, and the pixel circuit in an $(n+3)^{th}$ row are at the first pre-scanning phase 2Y.

When the quantity of pre-writing phases is 2 and the pixel circuits in the $n^{th}$ row are at the first target data writing phase 1Z ($n \le N-4$, and N is the total quantity of rows to be displayed), a voltage stored in the parasitic capacitor C1 is written into the gate electrode of each driving transistor Td in the $n^{th}$ row. The pixel circuits in the $(n+2)^{th}$ row are at the second pre-writing phase 2Y, the pixel circuits in an $(n+4)^{th}$ row are at the first pre-writing phase 1Y, and the voltage stored in the parasitic capacitor C1 is also written into the gate electrodes of the driving transistors Td in the $(n+^2)^{th}$ and $(n+4)^{th}$ rows. At this time, on each data line Da, it is equivalent to that three storage capacitors C2 are coupled in parallel to achieve voltage division with the parasitic capacitor C1. Hence, the voltage written into the gate electrode of the driving transistor Td in the $n^{th}$ row is calculated through $$V(n) = \frac{Cdata(Vdata - Vth)}{3Cst + Cdata} \quad (n \le N-4),$$

where Cdata represents a capacitance of the parasitic capacitor C1, Vdata represents the voltage stored in the parasitic capacitor C1, Vth represents a threshold voltage of the driving transistor Td, and Cst is a capacitance of the storage capacitor C2.

When the pixel circuits in the $(n+2)^{th}$ row are at the first target data writing phase 1Z (as shown by a middle part of FIG. 1*f*, that is, when the target scanning signal is applied to the pixel circuits in the $(n+2)^{th}$ row), the voltage stored in the parasitic capacitor C1 is written into the gate electrode of each driving transistor Td of the pixel circuits 11 in the $(n+2)^{th}$ row. At the same time, the pixel circuits in the $(n+4)^{th}$ row are at the second pre-writing phase 2Y and receive the pre-scanning signal, so that the voltage stored in the parasitic capacitor C1 is written into the gate electrode of the driving transistor Td in each pixel circuit 11 in the $(n+4)^{th}$ row. At this time, it is equivalent to that two storage capacitors C2 are coupled in parallel to achieve the voltage division with the parasitic capacitor C1, and the voltage written into the gate electrode of the driving transistor Td in each pixel circuit 11 in the $(n+2)^{th}$ row is calculated through $$V(n+2) = \frac{Cdata(Vdata - Vth)}{2Cst + Cdata} \quad (n \le N-4).$$

When the pixel circuits in the last row, that is, the pixel circuits in the $(n+4)^{th}$ row, enter the first target data writing phase 1Z, the target data has been written into the pixel circuits in the $n^{th}$ row and the $(n+2)^{th}$ row. At this time, only one storage capacitor C2 is used to achieve the voltage division with the parasitic capacitor C1, and the voltage written into the gate electrode of the driving transistor Td in each pixel circuit in the $(n+4)^{th}$ row is calculated through $$V(n+4) = \frac{Cdata(Vdata - Vth)}{Cst + Cdata} \quad (n \le N-4).$$

Hence, from the pixel circuits in the $n^{th}$ row to the pixel circuits in the $(n+4)^{th}$ row, the voltages written into the gate electrodes of the driving transistors Td increase, and there is a relatively large difference between the voltages written into the gate electrodes of the driving transistors Td in the pixel circuits in the last few rows. In this way, insufficient brightness occurs for a bright image.

The same situation occurs for the pixel circuits in the $(n-1)^{th}$ row, $(n+1)^{th}$ row and $(n+3)^{th}$ row. When the pixel circuits in the $(n+1)^{th}$ row are at the target data writing phase, the voltage written into the gate electrode of the driving transistor Td in each pixel circuit in the $(n+1)^{th}$ row is identical to the voltage written into the gate electrode of the driving transistor Td in each pixel circuit in the $(n+2)^{th}$ row, i.e., $$V(n+1) = V(n+2) = \frac{Cdata(Vdata - Vth)}{2Cst + Cdata} \quad (n \le N-4).$$

When the pixel circuits in the $(n+3)^{th}$ row are at the data signal writing phase, the voltage written into the gate electrode of the driving transistor Td in each pixel circuit in the $(n+3)^{th}$ row is identical to the voltage written into the gate electrode of the driving transistor Td in each pixel circuit in the $(n+4)^{th}$ row, i.e., $$V(n+3) = V(n+4) = \frac{Cdata(Vdata - Vth)}{Cst + Cdata} \quad (n \le N-4).$$

In a word, for the pixel circuits in the last few rows, the voltages written into the gate electrodes of the driving transistors Td at the target data writing phase are different, so a display brightness value of each pixel unit in the last few rows is different from a display brightness value of the other pixel unit.

An object of the present disclosure is to provide a display panel, a display device and a driving method, so as to solve the above-mentioned problems.

Figure 2:
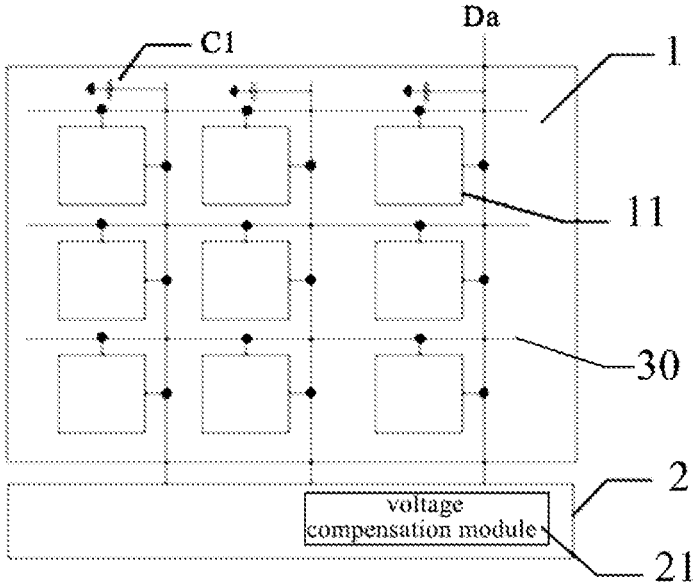
FIG. 2 is a schematic view of a display panel according to one embodiment of the present disclosure.
Figure 3:
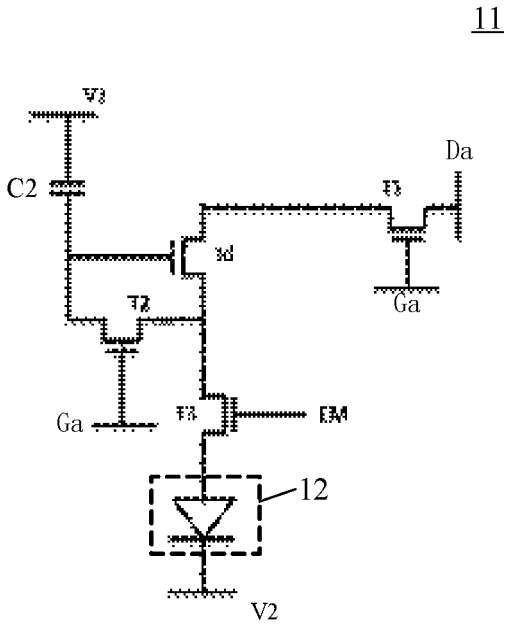
FIG. 3 is a schematic view of a pixel circuit of the display panel according to one embodiment of the present disclosure.

As shown in FIG. 2 and FIG. 3, the present disclosure provides in some embodiments a display panel, which includes a display substrate 1 and a driving chip 2.

The driving chip 2 is configured to transmit a control signal and a data signal to the display substrate 1.

The display substrate 1 includes a plurality of data lines Da and a plurality of pixel circuits 11 arranged in rows. Each pixel circuit 11 includes a storage capacitor C2 and a driving transistor Td. The storage capacitor C2 is coupled between a gate electrode of the driving transistor Td and a first power source end V1, and each pixel circuit 11 is electrically coupled to the data line Da. The display substrate 1 further includes a conductive member insulated and spaced apart from the data line Da, and the data line and the conductive member form a parasitic capacitor C1.

The display panel is configured to write the data signal to a corresponding pixel circuit 11 at at least one pre-writing phase (for example, 1Y and 2Y) and a target data writing phase (for example, 1Z).

The driving chip 2 further includes a voltage compensation module 21 configured to obtain a compensation voltage value for the pixel circuits 11 in each row in accordance with the quantity of pre-writing phases.

Each pixel circuit is configured to write a pre-writing voltage stored in the parasitic capacitor C1 to the gate electrode of the driving transistor Td in response to a pre-scanning signal at the pre-writing phase, and write a target writing voltage stored in the parasitic capacitor C1 to the gate electrode of the driving transistor Td in response to a target scanning signal at the target data writing phase. Each of the pre-writing voltage and the target writing voltage includes the compensation voltage value.

Illustratively, the conductive member includes a conductive structure other than the data line Da in the display substrate. For example, the conductive structure includes, but not limited to, a gate line 30.

The voltage value applied to the pixel circuits 11 in each row is compensated through the voltage compensation module 21, i.e., the voltage compensation value is directly written into the data signal, so as to enable the voltage values written into the driving transistors of the pixel circuits 11 in each row to be the same, namely, enable pre-writing voltages applied to the pixel circuits 11 in each row at the pre-writing phase to be the same, and enable target writing voltages applied to the pixel circuits 11 in each row at the target data writing phase to be the same. As a result, it is able to solve the problem in the related art where insufficient brightness occurs for pixels in the last few rows when the display panel is driven in a multi-pulse driving mode, i.e., it is able to compensate the pixel circuits 11 in the last few rows with the voltage compensation value, thereby to provide all the pixels of the display panel with a same brightness value, improve the display evenness of the display panel, and provide the display panel with a wide application prospect.

In the embodiments of the present disclosure, the parasitic capacitor C1 is formed between the data line Da and the conductive member after the data line Da has received the pre-scanning signal or the target scanning signal. In the embodiments of the present disclosure, a voltage is stored in the parasitic capacitance C1. The voltage stored in the parasitic capacitance C1 is outputted as a pre-writing voltage to the pixel circuit 11 at the pre-writing phase, and outputted as a target writing voltage to the pixel circuit 11 at the target data writing phase.

At the pre-writing phase, the pre-writing voltage is used to turn on the driving transistor Td before the target data writing phase, so as to improve a hysteresis effect of the driving transistor Td. Hence, in the embodiments of the present disclosure, through improving the hysteresis effect of the driving transistor Td at at least one pre-writing phase, it is able to increase the scanning efficiency. At the target writing phase, through the target writing voltage, it is able to drive a light-emitting element 12 electrically coupled to the pixel circuit 11 to emit light at a target brightness value.

In the embodiments of the present disclosure, each of the pre-writing voltage and the target writing voltage includes the compensation voltage value, so as to enable the voltage values written into the driving transistors of the pixel circuits 11 in each row to be the same, namely, enable the pre-writing voltages applied to the pixel circuits 11 in each row at the pre-writing phase to be the same, and enable the target writing voltages applied to the pixel circuits 11 in each row at the target data writing phase to be the same. When all the light-emitting elements are driven to emit light, it is able to provide the light-emitting elements with an identical brightness value, thereby to improve the display evenness of the display panel, and provide the display panel with a wide application prospect.

It should be appreciated that, in the embodiments of the present disclosure, the pre-writing voltage and the target writing voltage are defined only in accordance with their functions. In actual use, the pixel circuits 11 in a plurality of rows are electrically coupled to the data lines Da simultaneously within one pulse scanning period, so a value of the target writing voltage applied to the pixel circuits 11 in a first row is identical to a value of the pre-writing voltage applied to the pixel circuits 11 in the other rows.

It should be further appreciated that, in the embodiments of the present disclosure, the quantity of pre-writing phases is at least one. The quantity of the pre-writing phases is selected in accordance with the practical need, so as to improve the hysteresis effect of the driving transistor Td, and accelerate a driving speed, thereby to achieve a maximum effect.

Due to different pre-writing phases, the quantities of rows of pixel circuits where voltage compensation needs to be performed are different too.

Based on the above-mentioned voltage change in the gate electrodes of the driving transistors Td in the pixel circuits in the $(n-1)^{th}$ to $(n+4)^{th}$ rows, when the scanning end is driven through M pulses, the voltage written into the gate electrode of the driving transistors Td in each row is calculated through $$V(N-a) = \frac{Cdata(Vdata - Vth)}{Cst + Cdata} \quad (a = 0 \text{ or } 1),$$

$$V(N-a) = \frac{Cdata(Vdata - Vth)}{2Cst + Cdata} \quad (a = 2 \text{ or } 3),$$

$$\ldots, V(N-a) = \frac{Cdata(V - Vth)}{M \cdot Cst + Cdata} \quad (a \le 2M - 2),$$

where a is an integer greater than or equal to 0.

In a possible embodiment of the present disclosure, the voltage compensation module 21 is further configured to determine, in accordance with the quantity of pre-writing phases, the quantity of rows of pixel circuits where voltage compensation needs to be performed as A=(2Q−1)+1, and a range of the rows of pixel circuits where voltage compensation needs to be performed as N−(2Q−1) to N, where A represents the quantity of rows of pixel circuits where voltage compensation needs to be performed in the display panel, Q represents the quantity of pre-writing phases, Q is a natural number greater than or equal to 1, N represents the quantity of rows of pixels in the display panel, and N is a natural number greater than or equal to 2.

In the embodiments of the present disclosure, the quantity of pre-writing phases and the quantity of pixel circuits 11 where the voltage compensation needs to be performed are determined through researches and experiments, so as to enable the voltage compensation module 21 to compensate for different quantities of pixel circuits 11 when the display panel is driven through different quantities of pulses in real time. In this way, it is able to improve the adaptability of the voltage compensation module 21, and prevent the occurrence of display unevenness for the last few rows when the multi-pulse driving mode is adopted, thereby to improve a display effect of the display panel and provide the display panel with a wide application prospect.

In a specific embodiment of the present disclosure, the quantity of pre-writing phases is two (i.e. Q=2). When M=3, a 3-pulse driving phase includes 2 pre-writing phases and 1 target data writing phase (M=Q+1). At this time, the quantity of rows of the pixel circuits 11 where the voltage compensation needs to be performed is A=4. As shown in FIG. 1*f*, when the $(n+4)^{th}$ row is the last row (namely, N=n+4), a range of rows of the pixel circuits where the voltage compensation needs to be performed is the $(n+1)^{th}$ row to the $(n+4)^{th}$ row, i.e., the $(n+1)^{th}$ row, the $(n+^{2})^{th}$ row, the $(n+3)^{th}$ row and the $(n+4)^{th}$ row. The voltage compensation needs to be performed for these four rows of the pixel circuits 11.

Based on the above, in rows of the pixel circuits where the voltage compensation needs to be performed, the pre-writing voltages or the target writing voltages applied to the pixel circuits in the rows are different, so the compensation voltage values corresponding to rows of pixel circuits are different.

In a possible embodiment of the present disclosure, the voltage compensation module 21 is further configured to obtain the compensation voltage value for the pixel circuits 11 in each row in accordance with a position of a row where the pixel circuit 11 is located and the quantity of pre-writing phases through ΔV(n−a)=V(n−2Q)−V(n−a), where n is an integer less than or equal to N, a is an integer greater than or equal to 0 and less than A, V(N−2Q) represents a writing voltage to be applied to the pixel circuit in a row where pixel compensation does not need to be performed, and V(N−a) represents a writing voltage to be applied to the pixel circuit in a row where pixel compensation needs to be performed.

Still taking Q=2 and N=n+4 as an example, at this time, A=4, and it is necessary to obtain the compensation voltage values for the pixel circuits 11 in the $(n+1)^{th}$ row, the $(n+2)^{th}$ row, the $(n+3)^{th}$ row and the $(n+4)^{th}$ row.

For example, when a=0, a compensation voltage value for the pixel circuits in the $(n+4)^{th}$ row is calculated through ΔV((n+4)−0)=V((n+4)−2*2)−V((n+4)−0), i.e., ΔV(n+4)=V(n)−V(n+4).

For another example, when a=1, a compensation voltage value for the pixel circuits in the $(n+3)^{th}$ row is calculated through ΔV((n+4)−1)=V((n+4)−2*2)−V((n+4)−1), i.e., ΔV(n+3)=V(n)−V(n+3).

In the embodiments of the present disclosure, after determining the quantity of pixel circuits where the voltage compensation needs to be performed in accordance with the quantity of pre-writing phases, the voltage compensation value for the pixel circuits 11 in each row where the voltage compensation needs to be performed is accurately determined on the basis of V(n−2Q), so as to perform the voltage compensation for the pixel circuits in each row adaptively. In this way, when the light-emitting elements are driven to emit light, it is able to provide the light-emitting elements with a same brightness value, thereby to improve the display evenness of the display panel as a whole.

In a possible embodiment of the present disclosure, the plurality of data lines Da in the display substrate 1 is divided into a plurality of data line groups. Each data line group includes at least two data lines Da and a data selector corresponding to each data line. Each data line group is configured to, in response to a gating state of each data selector, apply a data signal from the driving chip to a corresponding data line.

Figure 4:
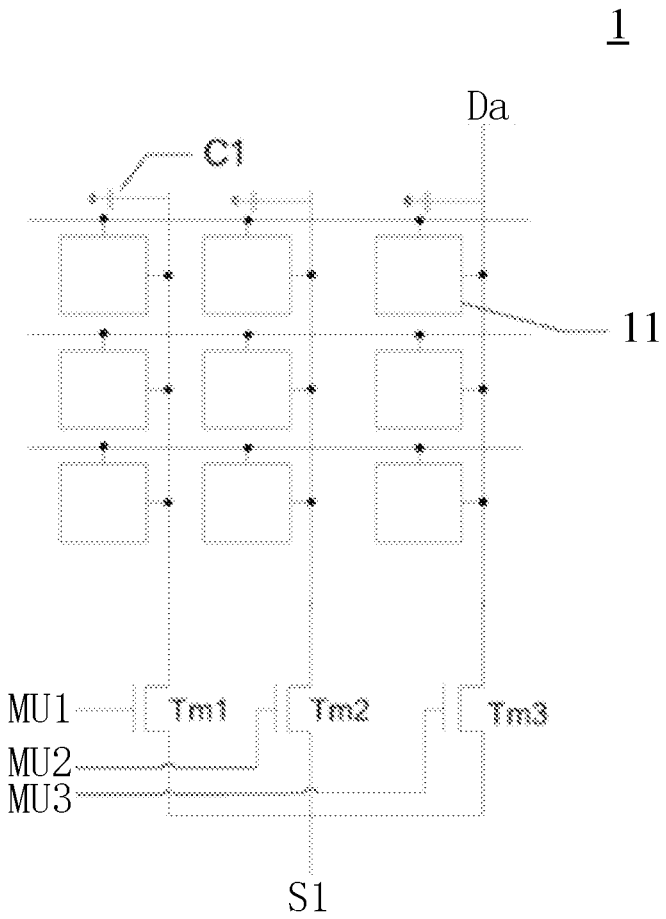
FIG. 4 is a schematic view of the display panel including a plurality of data selectors according to one embodiment of the present disclosure.

To be specific, as shown in FIG. 4, one data line group includes three data lines Da and three data selectors. Among the three data selectors, a first data selector includes a gating transistor Tm1, a second data selector includes a gating transistor Tm2, and a third data selector includes a gating transistor Tm3. The gating transistor Tm1 is controlled by a gating end MU1, the gating transistor Tm2 is controlled by a gating end MU2, and the gating transistor Tm3 is controlled by a gating end MU3. Input ends of the three data selectors are electrically coupled to the data signal input end S1. The data line group is configured to enable the data signal input end S1 to be electrically coupled to the data lines Da in the data line group sequentially within each row scanning period, so as to charge the parasitic capacitor C1 corresponding to each data line Da sequentially.

To be specific, as shown in FIG. 1*a*, one data line group includes two data lines Da and two data selectors. Among the two data selectors, a first data selector includes a gating transistor Tm1, and a second data selector includes a gating transistor Tm2. The gating transistor Tm1 is controlled by the gating end MU1, and the gating transistor Tm2 is controlled by the gating end MU2. Input ends of the two data selectors are electrically coupled to the data signal input end S1.

According to the display panel in the embodiments of the present disclosure, through the plurality of data line groups, it is able to apply the data signal from the driving chip to the data line corresponding to the gated data selector. In this way, it is able to reduce a space occupied by lines coupled to the data signal input end S1, thereby to provide the display panel with a narrow bezel.

Figure 5A:
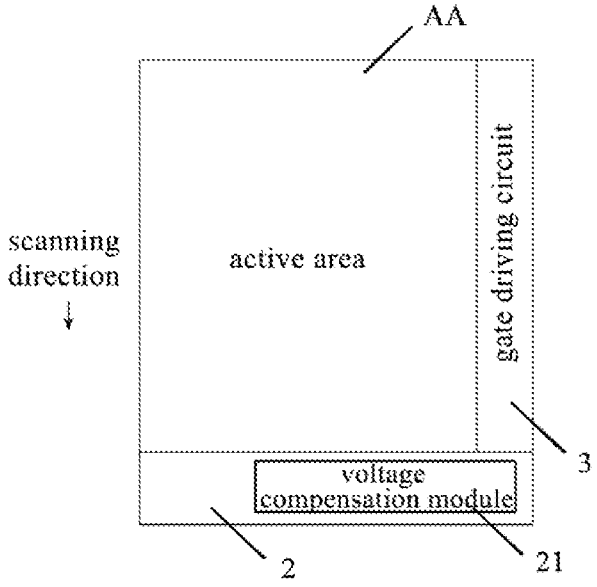
FIG. 5*a* is a schematic view of a single-sided gate driving circuit of the display panel according to one embodiment of the present disclosure.
Figure 5B:
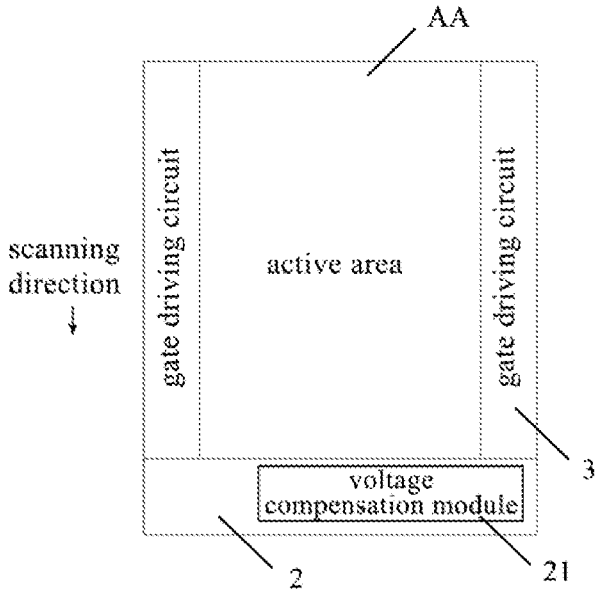
FIG. 5*b* is a schematic view of a double-sided gate drive circuit of the display panel according to one embodiment of the present disclosure.

In a possible embodiment of the present disclosure, as shown in FIG. 5*a* and FIG. 5*b*, the display substrate 1 further includes a gate driving circuit 3 configured to output the pre-scanning signal to a corresponding pixel circuit 11 in accordance with the quantity of pre-writing phases while outputting the target scanning signal to the pixel circuits 11 in an $n^{th}$ row, where n is an integer less than or equal to N. It should be appreciated that, an active area AA is also shown in FIGS. 5*a* and 5*b*.

In the embodiments of the present disclosure, taking FIG. 5*a* as an example, the driving chip 2 is configured to transmit the control signal and the data signal to the display substrate 1 through the gate driving circuit 3, so as to scan the pixel circuits progressively, starting from the row away from the voltage compensation module 21. During the scanning, the voltage compensation module 21 is configured to obtain the compensation voltage value for the pixel circuits in each row in accordance with the quantity of pre-writing phases, and input the compensation voltage value to a corresponding pixel circuit where the voltage compensation needs to be performed through the data signal, so as to provide the light-emitting elements driven by the pixel circuits with a same brightness value.

In addition, within one pulse scanning period, the pixel circuits 11 in a plurality of rows are simultaneously electrically coupled to the corresponding data lines Da under the control of the gate driving circuit 3. In this procedure, the pixel circuits 11 in adjacent rows are at different driving phases. In a specific embodiment of the present disclosure, the quantity of pre-writing phases is two, and the entire driving phase includes two pre-writing phases and one target data writing phase. Further, when the pixel circuits 11 in the $n^{th}$ row in FIG. 1*e* are at the target data writing phase in FIG. 1*f*, the pixel circuits in the $(n+2)^{th}$ and $(n+4)^{th}$ rows are electrically coupled to the data lines Da under the control of the gate driving circuit, the pixel circuits in the $(n+2)^{th}$ row are at the second pre-writing phase, and the pixel circuits in the $(n+4)^{th}$ row are at the first pre-writing phase. In this state, the gate driving circuit outputs the target scanning signal to the pixel circuits in the $n^{th}$ row, and outputs the pre-scanning signal to the pixel circuits in the $(n+2)^{th}$ row and the $(n+4)^{th}$ row. When the target writing voltage and the pre-writing voltage applied to the pixel circuits in the $n^{th}$ row, the $(n+2)^{th}$ row and the $(n+4)^{th}$ row are compensated through the voltage compensation module 21, it is able to apply a same voltage to the driving transistors Td of the pixel circuits 11 in each row, and provide the target scanning signal and the pre-scanning signal with a same voltage value. As a result, when the light-emitting elements are driven to emit light, it is able to provide the light-emitting elements with a same brightness value, thereby to improve the display evenness of the display panel and provide the display panel with a wide application prospect.

In a possible embodiment of the present disclosure, the gate driving circuit 3 is a single-sided gate driving circuit in FIG. 5*a* or a double-sided gate driving circuit in FIG. 5*b*. A structure of the gate driving circuit is selected in accordance with the practical need, and thus will not be particularly defined herein.

In a possible embodiment of the present disclosure, as shown in FIG. 3, each pixel circuit 11 includes an input transistor T1, a threshold compensation transistor T2, a driving transistor Td, an enabling transistor T3, a storage capacitor C2, and a light-emitting element 12. Each of the input transistor T1, the threshold compensation transistor T2, the driving transistor Td, and the enabling transistor T3 includes a gate electrode, a first electrode and a second electrode, the storage capacitor C2 includes a first electrode and a second electrode, and the light-emitting element includes a first electrode and a second electrode.

The first electrode of the storage capacitor C2 is configured to receive a first power source signal V1, and the second electrode of the storage capacitor C2 is electrically coupled to the gate electrode of the driving transistor Td.

The gate electrode of the input transistor T1 is configured to receive the pre-scanning signal and the target scanning signal, the first electrode of the input transistor T1 is electrically coupled to the data line Da, and the second electrode of the input transistor T1 is electrically coupled to the first electrode of the driving transistor Td. The input transistor T1 is configured to enable the data line Da to be electrically coupled to the first electrode of the driving transistor Td in response to any one of the pre-scanning signal and the target scanning signal.

The gate electrode of the threshold compensation transistor T2 is configured to receive the pre-scanning signal and the target scanning signal, the first electrode of the threshold compensation transistor T2 is electrically coupled to the second electrode of the driving transistor Td, and the second electrode of the threshold compensation transistor T2 is electrically coupled to the gate electrode of the driving transistor Ta. The threshold compensation transistor T2 is configured to enable the second electrode of the driving transistor Td to be electrically coupled to the gate electrode of the driving transistor Td in response to any one of the pre-scanning signal and the target scanning signal.

The gate electrode of the enabling transistor T3 is configured to receive an enabling signal, the first electrode of the enabling transistor T3 is electrically coupled to the second electrode of the driving transistor Td, and the second electrode of the enabling transistor T3 is electrically coupled to the first electrode of the light-emitting element 12. The enabling transistor T3 is configured to enable the second electrode of the driving transistor Td to be electrically coupled to the first electrode of the light-emitting element 12 in response to the enabling signal.

The second electrode of the light-emitting element 12 is configured to receive a second power source signal V2.

In the embodiments of the present disclosure, as shown in FIG. 3, the first electrode of the input transistor T1 is electrically coupled to the data line Da, the second electrode of the input transistor T1 is electrically coupled to the first electrode of the driving transistor Td, and the gate electrode of the driving transistor Td is coupled to the scanning end Ga for receiving the pre-scanning signal and the target scanning signal. The second electrode of the driving transistor Td is electrically coupled to the first electrode of the enabling transistor T3, and the gate electrode of the driving transistor Td is electrically coupled to the second electrode of the threshold compensation transistor T2 and the second electrode of the storage capacitor C2. The first electrode of the storage capacitor C2 is configured to receive the first power source signal V1. The gate electrode of the threshold compensation transistor T2 is coupled to the scanning end Ga for receiving the pre-scanning signal and the target scanning signal. The second electrode of the enabling transistor T3 is electrically coupled to the first electrode of the light-emitting element 12, the gate electrode of the enabling transistor T3 is electrically coupled to a light-emission control end EM, and the light-emission control end EM is configured to provide the enabling signal. The second electrode of the light-emitting element 12 is configured to receive the second power source signal V2.

In the embodiments of the present disclosure, at the target writing phase, the target scanning signal is applied to the gate electrode of the threshold compensation transistor T2 and the gate electrode of the input transistor T1 through the scanning end Ga, so as to turn on the threshold compensation transistor T2 and the input transistor T1. When the input transistor T1 is turned on, the target writing voltage stored in the parasitic capacitor C1 is applied to the first electrode of the driving transistor Td. When the threshold compensation transistor T2 is turned on, the second electrode and the gate electrode of the driving transistor Td are electrically coupled to each other, so as to change a triode to a diode. A gate voltage of the driving transistor Td is maintained as Vdata+Vth under the effect of the storage capacitor C2. When the enabling signal is valid, the enabling transistor T3 is turned on, and the light-emitting element 12 emits light.

It should be appreciated that, at the pre-writing phase, the pre-scanning signal is applied to the gate electrode of the threshold compensation transistor T2 and the gate electrode of the input transistor T1 through the scanning end Ga. A driving process of the threshold compensation transistor T2, the driving transistor Td, the input transistor T1, and the enabling transistor T3 is the same as the above-mentioned target writing process, and thus will not be particularly defined herein.

In a possible embodiment of the present disclosure, a process of driving the display panel will be described as follows.

At first, the data line Da is configured to receive the data signal from the driving chip in response to a gating state of a corresponding data selector.

As shown in FIG. 4, the signal input end S1 receives the data signal from the driving chip, the data selectors are sequentially gated under the control of Mu1, Mu2, and Mu3, and each data line group coupled to the data selector transmits the data signal to a corresponding pixel circuit. For example, as shown in FIG. 1*e*, the data signal is inputted to the pixel circuits in the $n^{th}$ row, the $(n+2)^{th}$ row, and the $(n+4)^{th}$ row.

Next, the voltage compensation module of the driving chip obtains the compensation voltage value for the pixel circuits in each row in accordance with the quantity of pre-writing phases.

Each scanning period includes the pre-writing phase and the target writing phase, so the voltage compensation module of the driving chip obtains the compensation voltage value for the pixel circuits in each row in accordance with the quantity of pre-writing phases. In a possible embodiment of the present disclosure, the voltage compensation module determines the quantity and range of the rows of pixel circuits where the voltage compensation needs to be performed in accordance with the quantity of pre-writing phases. Further, the voltage compensation module obtains the compensation voltage value for the pixel circuits in each row in accordance with the position of the row where the pixel circuit is located and the quantity of pre-writing phases, so as to determine the compensation voltage value for the pixel circuits in each row where the voltage compensation needs to be performed.

Each pixel circuit writes the pre-writing voltage stored in the parasitic capacitor to the gate electrode of the driving transistor in response to the pre-scanning signal at the pre-writing phase.

The pre-writing voltage includes the compensation voltage value from the voltage compensation module. The compensated pre-writing voltage is written into the gate electrode of the driving transistor, so as to turn on the driving transistor Td before the target data writing phase, thereby to improve the hysteresis effect of the driving transistor Td.

Then, each pixel circuit writes the target writing voltage stored in the parasitic capacitor to the gate electrode of the driving transistor in response to the target scanning signal at the target data writing phase, and the target writing voltage includes the compensation voltage value.

When the pixel circuits in the same row enter the target data writing phase after the pre-writing phase, the compensated target writing voltage is written into the gate electrode of the driving transistor, so as to drive the light-emitting element electrically coupled to the pixel circuit to emit light at a target brightness value and compensate for the brightness in the last few rows, thereby to achieve the display evenness of the display panel.

According to the embodiments of the present disclosure, the pre-writing voltage and target writing voltage applied to the pixel circuit are compensated through the voltage compensation module, and the compensated pre-writing voltage and target writing voltage are applied to the gate electrode of the driving transistor, so as to apply a same voltage to the driving transistors of the pixel circuits and apply a same driving voltage to the light-emitting elements of the pixel circuits, thereby to improve the display evenness of the display panel, improve the display effect and provide the display panel with a wide application prospect.

Figure 6:
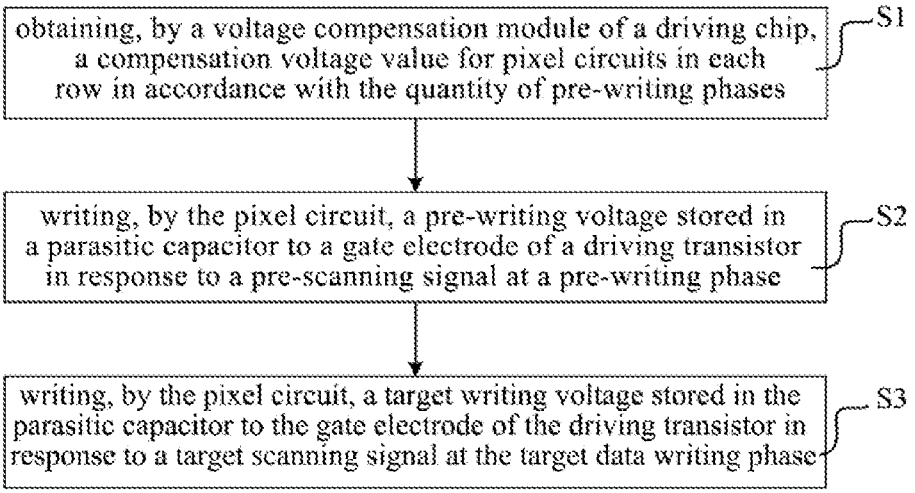
FIG. 6 is a flow chart of a method for driving the display panel according to one embodiment of the present disclosure.

Based on the above, as shown in FIG. 6, the present disclosure further provides in some embodiments a method for driving the above-mentioned display panel, which includes: S1 of obtaining, by the voltage compensation module of the driving chip, a compensation voltage value for pixel circuits in each row in accordance with the quantity of pre-writing phases; S2 of writing, by the pixel circuit, a pre-writing voltage stored in a parasitic capacitor to a gate electrode of a driving transistor in response to a pre-scanning signal at a pre-writing phase, the pre-writing voltage including the compensation voltage value; and S3 of writing, by the pixel circuit, a target writing voltage stored in the parasitic capacitor to the gate electrode of the driving transistor in response to a target scanning signal at the target data writing phase, the target writing voltage including the compensation voltage value.

In a possible embodiment of the present disclosure, the obtaining, by the voltage compensation module of the driving chip, the compensation voltage value for the pixel circuits in each row in accordance with the quantity of pre-writing phases includes: determining, by the voltage compensation module in accordance with the quantity of pre-writing phases, the quantity of rows of pixel circuits where voltage compensation needs to be performed as $A=(2Q-1)+1$, and a range of the rows of pixel circuits where voltage compensation needs to be performed as $N-(2Q-1)$ to N, where A represents the quantity of rows of pixel circuits where voltage compensation needs to be performed in the display panel, Q represents the quantity of pre-writing phases, Q is a natural number greater than or equal to 1, N represents the quantity of rows of pixels in the display panel, and N is a natural number greater than or equal to 2; and obtaining, by the voltage compensation module, the compensation voltage value for the pixel circuits in each row in accordance with a position of a row where the pixel circuit is located and the quantity of pre-writing phases through $\Delta V(n-a)=V(n-2Q)-V(n-a)$, where n is an integer less than or equal to N, a is an integer greater than or equal to 0 and less than A, $V(N-2Q)$ represents a writing voltage to be applied to the pixel circuit in a row where pixel compensation does not need to be performed, and $V(N-a)$ represents a writing voltage to be applied to the pixel circuit in a row where pixel compensation needs to be performed.

In a possible embodiment of the present disclosure, the plurality of data lines in the display substrate is divided into a plurality of data line groups, and each data line group includes at least two data lines and a data selector corresponding to each data line. The method further includes, in response to a gating state of each data selector, applying, by each data line group, a data signal from the driving chip to a corresponding data line.

In a possible embodiment of the present disclosure, the display substrate further includes a gate driving circuit, and the method further includes outputting, by the gate driving circuit, the pre-scanning signal to a corresponding pixel circuit in accordance with the quantity of pre-writing phases while outputting the target scanning signal to the pixel circuits in an $n^{th}$ row, where n is an integer less than or equal to N.

When driving the display panel, the pre-writing voltage and target writing voltage applied to the pixel circuit are compensated through the voltage compensation module, and the compensated pre-writing voltage and target writing voltage are applied to the gate electrode of the driving transistor, so as to apply a same voltage to the driving transistors of the pixel circuits and apply a same driving voltage to the light-emitting elements of the pixel circuits, thereby to improve the display evenness of the display panel, improve the display effect and provide the display panel with a wide application prospect.

The method in the embodiments of the present disclosure corresponds to the display panel mentioned hereinabove, so the implementation of the method shall refer to that of the display panel, which will thus not be particularly defined herein.

The present disclosure further provides in some embodiments a display device including the above-mentioned display panel. Illustratively, the display device is a liquid crystal display device or an OLED display device. The display device is any product or member having a display function, such as mobile phone, tablet computer, television, display, laptop computer, digital photo frame or navigator.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A display panel, comprising:

a display substrate and a driving chip, wherein the driving chip is configured to transmit a control signal and a data signal to the display substrate;

the display substrate comprises a plurality of data lines and a plurality of pixel circuits arranged in rows;

each pixel circuit comprises a storage capacitor and a driving transistor, the storage capacitor is coupled between a gate electrode of the driving transistor and a first power source end, and each pixel circuit is electrically coupled to the data line;

the display substrate further comprises a conductive member insulated and spaced apart from the data line, and the data line and the conductive member form a parasitic capacitor;

the display panel is configured to write the data signal to a corresponding pixel circuit at at least one pre-writing phase and a target data writing phase;

the driving chip is further configured to obtain a compensation voltage value for the pixel circuits in each row in accordance with a number of pre-writing phases;

each pixel circuit is configured to write a pre-writing voltage stored in the parasitic capacitor to the gate electrode of the driving transistor in response to a pre-scanning signal at the pre-writing phase, and write a target writing voltage stored in the parasitic capacitor to the gate electrode of the driving transistor in response to a target scanning signal at the target data writing phase; and both the pre-writing voltage and the target writing voltage comprise the compensation voltage value.

2. The display panel according to claim 1, wherein the driving chip is further configured to determine, in accordance with the number of pre-writing phases, quantity a number of rows of pixel circuits where voltage compensation needs to be performed as $A=(2Q-1)+1$, and a range of the rows of pixel circuits where voltage compensation needs to be performed as $N-(2Q-1)$ to N, where A represents the number of rows of pixel circuits where voltage compensation needs to be performed in the display panel, Q represents the number of pre-writing phases, Q is a natural number greater than or equal to 1, N represents the quantity a number of rows of pixels in the display panel, and N is a natural number greater than or equal to 2, wherein the driving chip is further configured to obtain the compensation voltage value for the pixel circuits in each row in accordance with a position of a row where the pixel circuit is located and the number of pre-writing phases through $AV(n-a)=V(n-2Q)-V(n-a)$, where n is an integer less than or equal to N, a is an integer greater than or equal to 0 and less than A, $V(N-2Q)$ represents a writing voltage to be applied to the pixel circuit in a row where pixel compensation does not need to be performed, and $V(N-a)$ represents a writing voltage to be applied to the pixel circuit in a row where pixel compensation needs to be performed.

3. The display panel according to claim 2, wherein the plurality of data lines in the display substrate is divided into a plurality of data line groups, each data line group comprises at least two data lines and a data selector corresponding to each data line, and each data line group is configured to, in response to a gating state of each data selector, apply a data signal from the driving chip to a corresponding data line.

4. The display panel according to claim 1, wherein each pixel circuit comprises an input transistor, a threshold compensation transistor, a driving transistor, an enabling transistor, a storage capacitor and a light-emitting element;

each of the input transistor, the threshold compensation transistor, the driving transistor and the enabling transistor comprises a gate electrode, a first electrode and a second electrode, the storage capacitor comprises a first electrode and a second electrode, and the light-emitting element comprises a first electrode and a second electrode;

the first electrode of the storage capacitor is configured to receive a first power source signal, and the second electrode of the storage capacitor is electrically coupled to the gate electrode of the driving transistor;

the gate electrode of the input transistor is configured to receive the pre-scanning signal and the target scanning signal, the first electrode of the input transistor is electrically coupled to the data line, and the second electrode of the input transistor is electrically coupled to the first electrode of the driving transistor;

the input transistor is configured to enable the data line to be electrically coupled to the first electrode of the driving transistor in response to any one of the pre-scanning signal and the target scanning signal;

the gate electrode of the threshold compensation transistor is configured to receive the pre-scanning signal and the target scanning signal, the first electrode of the threshold compensation transistor is electrically coupled to the second electrode of the driving transistor, and the second electrode of the threshold compensation transistor is electrically coupled to the gate electrode of the driving transistor;

the threshold compensation transistor is configured to enable the second electrode of the driving transistor to be electrically coupled to the gate electrode of the driving transistor in response to any one of the pre-scanning signal and the target scanning signal;

the gate electrode of the enabling transistor is configured to receive an enabling signal, the first electrode of the enabling transistor is electrically coupled to the second electrode of the driving transistor, and the second electrode of the enabling transistor is electrically coupled to the first electrode of the light-emitting element;

the enabling transistor is configured to enable the second electrode of the driving transistor to be electrically coupled to the first electrode of the light-emitting element in response to the enabling signal; and the second electrode of the light-emitting element is configured to receive a second power source signal.

5. The display panel according to claim 1, wherein the display substrate further comprises a gate driving circuit configured to output the pre-scanning signal to a corresponding pixel circuit in accordance with the number of pre-writing phases while outputting the target scanning signal to the pixel circuits in an nth row, where n is an integer less than or equal to N.

6. The display panel according to claim 5, wherein the gate driving circuit is a single-sided gate driving circuit or a double-sided gate driving circuit.

7. A display device, comprising the display panel according to claim 1.

8. A method for driving the display panel according to claim 1, comprising:

obtaining, by the driving chip, a compensation voltage value for pixel circuits in each row in accordance with the number of pre-writing phases; writing, by the pixel circuit, a pre-writing voltage stored in a parasitic capacitor to a gate electrode of a driving transistor in response to a pre-scanning signal at a pre-writing phase, the pre-writing voltage comprising the compensation voltage value; and writing, by the pixel circuit, a target writing voltage stored in the parasitic capacitor to the gate electrode of the driving transistor in response to a target scanning signal at the target data writing phase, the target writing voltage comprising the compensation voltage value.

9. The method according to claim 8, wherein the obtaining, by the driving chip, the compensation voltage value for the pixel circuits in each row in accordance with the number of pre-writing phases comprises: determining, by the driving chip in accordance with the number of pre-writing phases, a number of rows of pixel circuits where voltage compensation needs to be performed as $A=(2Q-1)+1$, and a range of the rows of pixel circuits where voltage compensation needs to be performed as $N-(2Q-1)$ to N, where A represents the number of rows of pixel circuits where voltage compensation needs to be performed in the display panel, Q represents the number of pre-writing phases, Q is a natural number greater than or equal to 1, N represents a number of rows of pixels in the display panel, and N is a natural number greater than or equal to 2; and obtaining, by the driving chip, the compensation voltage value for the pixel circuits in each row in accordance with a position of a row where the pixel circuit is located and the number of pre-writing phases through $AV(n-a)=V(n-2Q)-V(n-a)$, where n is an integer less than or equal to N, a is an integer greater than or equal to 0 and less than A, $V(N-2Q)$ represents a writing voltage to be applied to the pixel circuit in a row where pixel compensation does not need to be performed, and $V(N-a)$ represents a writing voltage to be applied to the pixel circuit in a row where pixel compensation needs to be performed.

10. The method according to claim 8, wherein the plurality of data lines in the display substrate is divided into a plurality of data line groups, and each data line group comprises at least two data lines and a data selector corresponding to each data line, wherein the method further comprises, in response to a gating state of each data selector, applying, by each data line group, a data signal from the driving chip to a corresponding data line.

11. The method according to claim 8, wherein the display substrate further comprises a gate driving circuit, and the method further comprises outputting, by the gate driving circuit, the pre-scanning signal to a corresponding pixel circuit in accordance with the number of pre-writing phases while outputting the target scanning signal to the pixel circuits in an nth row, where n is an integer less than or equal to N.

* * * * *